US005320407A

United States Patent [19]

Tell

[11] Patent Number: 5,320,407

[45] Date of Patent: Jun. 14, 1994

[54] ADJUSTABLE FURNITURE SLIPCOVER

[76] Inventor: Celeste M. Tell, 2020 W. Thomas, Chicago, Ill. 60622

[21] Appl. No.: 880,585

[22] Filed: May 8, 1992

[51] Int. Cl.[5] ..... A47C 31/11

[52] U.S. Cl. ..... 297/228.11; 297/225; 297/229

[58] Field of Search ..... 297/219, 222, 225, 228, 297/229, 228.11, 228.1

[56] References Cited

U.S. PATENT DOCUMENTS

| | | | |
|---|---|---|---|
| 1,820,104 | 8/1931 | Whaley | 297/229 X |
| 1,889,662 | 11/1932 | Hyman | 297/229 X |
| 1,996,575 | 4/1935 | Fry et al. | 297/219 |
| 2,392,051 | 1/1946 | Lenz | 297/225 |
| 2,393,543 | 1/1946 | Lenz | 297/225 |
| 4,134,616 | 1/1979 | Christensen | 297/229 X |
| 4,838,610 | 6/1989 | Perrin | 297/228 X |

OTHER PUBLICATIONS

Brochure for "Shabby Chic."
"New York" Magazine, Oct. 7, 1992, cover and pp. 52.
"Metropolitan Home" Magazine, Aug. 1991, pp. 45.
"Metropolitan Home" Magazine, May 1991, pp 91.
"Interior" Magazine, Feb. 1991, pp. 52.
"House Beautiful" Magazine, Sept. 1991, pp. V-4.
"Metropolitan Home" Magazine, Aug. 1991, pp. 39.
Smith & Hawken Catalog, pp. 51.
Hanna Anderson catalog, items #1812 & 1804.

*Primary Examiner*—Michael F. Trettel
*Attorney, Agent, or Firm*—Jones, Day, Reavis & Pogue

[57] ABSTRACT

A slipcover which is variably adjustable to the dimensions of the piece of furniture to be covered and a method of covering a piece of furniture. Elongated, tubular, telescopically compressible channels of material are associated with the seams of the slipcover. Each channel contains a slideable cord having opposite ends departing from opposite ends of the channel. A reversibly fixable locking mechanism segregates the channel on a selected portion of the cord to match the corresponding dimension of the covered furniture. The method of covering the furniture comprises arranging the covering on the piece of furniture and adjusting the length of the channels to correspond to the corresponding dimension of the furniture.

10 Claims, 2 Drawing Sheets

FIG. 4
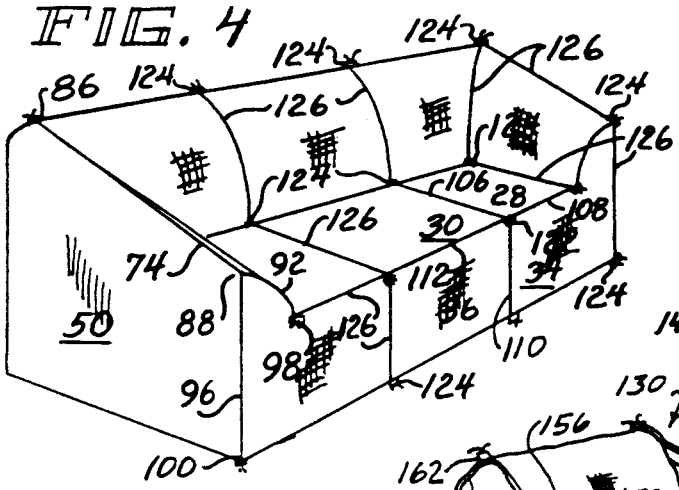
FIG. 5
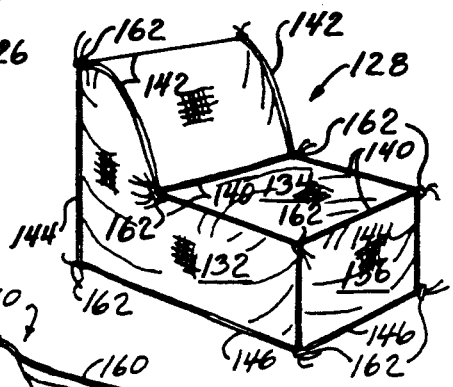
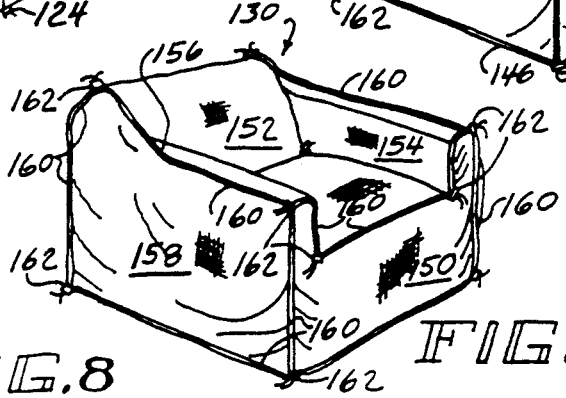
FIG. 6
FIG. 7
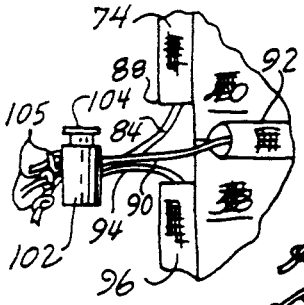
FIG. 8
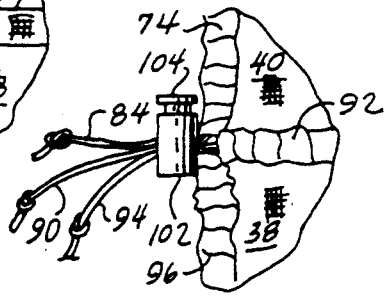
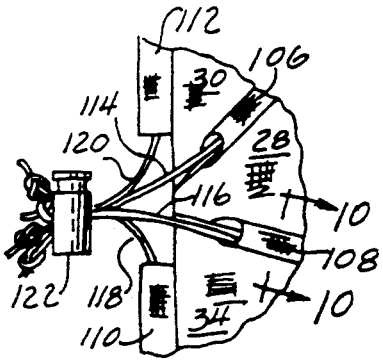
FIG. 9
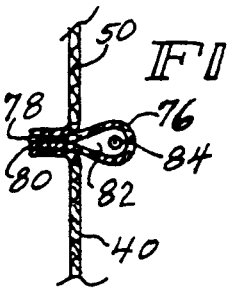
FIG. 10

ADJUSTABLE FURNITURE SLIPCOVER

BACKGROUND OF THE INVENTION

The present invention pertains generally to furniture coverings and methods for covering furniture. Specifically, the invention relates to slipcovers to cover furniture for protection or to improve the appearance of furniture and related methods of covering furniture.

Household and business furniture is available in a nearly infinite number of designs, styles, shapes, sizes and materials. Fabric covered furniture is very desireable in home and business settings because it provides a comfortable, usually cushioned place to sit for extended periods of time. The material used on the furniture adds an aesthetic feature to the decor of the surroundings and may be chosen because of its particular color, design and texture.

While fully or partially upholstered furniture is very desireable, it has commonly experienced problems. First, the upholstery is a fabric vulnerable to damage during use; it is easily stained by the spilling of drinks or the activities of children. Moreover, pets, such as cats or dogs, can damage the material with their claws or teeth.

A second limitation of upholstered furniture is that the upholstery cannot be easily removed. If the upholstery on the chair or sofa is stained, damaged or just not the right style, color, design or texture for the surrounding decoration, or just out of style, replacement of the upholstery material requires removal and replacement. This can be a complicated, time consuming and expensive activity which may require the services of a professional upholsterer.

In the past, furniture has been shielded so that expensive permanent custom removal and replacement of that material would not be necessary. These efforts took two general directions; custom coverings and throws. Both of these alternatives suffers from significant disadvantages.

Custom coverings, most often made of cloth, but also made of plastic, provide both stain and tear resistance. This type of covering provides a protective layer over the furnishing permanently fitted to its particular dimensions. It suffers from the disadvantage of being expensive and time consuming to make, usually requiring the services of a professional upholsterer. Moreover, the finished custom covering fits only a single piece of furniture.

Plastic custom coverings have the advantage of allowing for the underlying upholstery to be seen. However, the pleasing tactile experience of sitting or laying on fabric is lost because no contact is directly made by the user with the fabric. Because plastic often is hot and sticky in the summer and cold in the winter, it is a poor substitute for direct contact with the upholstery material. Moreover, plastic coverings, like fabric custom coverings, are custom fitted over the original fabric, requiring approximately the same time and expense as the reupholstering process.

The second alternative to reupholstering is the use of a throw. Throws are non-fitted, mass-produced pieces of material placed over the furniture to be covered. This provides the advantage of covering the original, old upholstery with new material without complex and expensive custom installation. Moreover, a throw provides protection both from liquid and tears or rips, similar to custom coverings and hides the stains, tears, and possibly ugly appearance of the underlying upholstery.

Throws suffer from a disadvantage. Because they were not permanently cut and installed on the particular piece of furniture, they do not tightly fit the furniture. Even if made of an eye catching material, throws often either appear wrinkled and in disarray or, if tucked-in to a piece of furniture to reduce the wrinkles, are subject to becoming disheveled upon the most minor of uses. Hence, while throws overcome some of the disadvantages of custom coverings, they suffer from the major disadvantages of not being fitted to the particular piece of furniture.

It is an object of the present invention to provide a slipcover which has adjustable dimensions.

It is another object of the present invention to provide a covering for furniture which can have some of its dimensions varied to closely match the dimensions of the furniture.

It is yet another object of the present invention to provide a slipcover which can be manually adjusted to fit different furniture pieces having varying shapes and sizes.

It is yet an additional object of the present invention to provide a furniture covering that can easily and quickly be fitted to a piece of furniture without professional installation.

It is yet a further object of the present invention to provide a furniture covering which is temporarily adjustable to the particular dimensions of a piece of furniture.

It is yet an additional object of the present invention to provide a method of adjustably and reversibly fitting a slipcover to a piece of furniture.

Other objects, features and advantages of this invention will be apparent from the following description and illustration of the preferred embodiment of the invention.

SUMMARY OF THE INVENTION

The present invention provides a slipcover having dimensions which are easily, quickly and reversibly adjusted to fit a particular piece of furniture. The adjustments are accomplished by the use of compressible channels running the length of certain dimensions of the slipcover. The compressible channels can be manually varied to match the corresponding dimension of the furniture item to be covered. Because the lengths of edges of the panels can be manually shortened or lengthened at will, the same slipcover will fit a variety of sizes and shapes of furniture, and can be easily and quickly readjusted to fit a different item of furniture having different size and shape.

The invention is particularly useful as a relatively inexpensive way to temporarily cover a sofa, chair or sectional with a fabric to protect a valuable, unmarred item of furniture from temporary threats, such as visiting children or pets. It also provides a relatively inexpensive way to cover an unsightly piece of furniture. In either case, the inventive slipcover does not need to be pre-fitted to the particular piece of furniture because the user can make all necessary adjustments during the initial installation of the slipcover. Moreover, the dimensions of the slipcover can be adjusted at any time during its lifetime by simply removing it from the first piece of furniture and installing it on a second piece of furniture, new adjustments being made at the time of the second installation. Hence, the same slipcover can be custom fitted to furniture of different sizes and shapes at the will of the user.

The adjustable slipcover would be sized to cover the general shape of a furniture item. For example, a sofa slipcover would have panels corresponding to a full size sofa with padded arms and back. Elongated tubular channels of fabric are sewn into the seam joints between the various panels and laces or cords run through the length of the channels. The compression of the channel will cause the selective shortening of the seam as desired by the user to match the corresponding dimension of the furniture. Similarly, the slipcover could have the general shape of a chair, sectional or other piece of furniture.

The channel is compressed by reversibly segregating it, i.e., telescopically bunching it, on a selected portion of the lace or cord. Each lace or cord exits the channel at two opposite channel ends. Channel compression is accomplished by a locking mechanism which can be variably fixed along the cord. Because the locking mechanism is wider than the diameter of the channel, moving the mechanism toward the opposite end of the cord will restrict the channel to the remaining portion of the cord. Thus, the seam dimension associated with the channel would be reduced.

Other than the locking mechanisms on either end of the cords, the cord is freely slideable within the channel. Movement of the locking mechanism to reduce the length of the cord upon which the channel can move slides the associated channel end along the cord without lateral restrictive attachment to the cords. Due to the equalizing forces along the length of the channel and its slideably free association with the cord, the channel can be evenly adjusted along the shortened section of the cord to which it is restricted.

Because the ends of the channels are near the ends of the seams, where each seam intersects other, perpendicularly oriented seams and associated channels, most cord ends will be near other, perpendicularly oriented cords. The corners of panels tend to have gatherings of lace or cord ends. The locking or stop mechanism can conveniently be associated with more than one adjacent cord end to restrict movement of more than one channel end relative to the cord. This reduces the number of locking mechanisms needed.

The invention also contemplates a method of adjustably and reversibly fitting a slipcover to a piece of furniture without cutting or sewing the material. The slipcover contains a series of channels associated with characteristic dimensions of the slipcover, each channel containing a freely slideable lace or cord. The ends of the cords are associated with a moveable stop which, when actuated, can slide along the cord to longitudinally compress the channel along a portion of the cord.

The method comprises covering the piece of furniture with the slipcover, aligning the seams of the slipcover with the seams of the piece of furniture, and fixing the stop on the cord to segregate the channel on a portion of the cord corresponding to the associated dimension of the furniture. Because of the reversibility of this process, the method can be reversed, to remove it for cleaning or for reinstallation on a larger sofa, chair or sectional. Each dimension is separately controlled, thus allowing the readjustment of the slipcover to a piece of furniture having some longer and some shorter dimensions.

BRIEF DESCRIPTION OF THE DRAWINGS

FIG. 4 is a perspective view of the present invention shown in a fully-expanded state;

FIG. 5 is a perspective view of a second embodiment of the present invention;

FIG. 6 is a perspective view of a third embodiment of the present invention;

FIG. 7 is a detailed view of a triple cord junction and grasping mechanism of the preferred embodiment of the present invention;

FIG. 8 is a detailed view of a triple cord junction of FIG. 7 with the grasping mechanism adjusted to shorten the dimensions of the panel intersections;

FIG. 9 is a detailed view of a quadruple cord junction of the preferred embodiment of the present invention; and FIG. 10 is a cross-sectional view of a channel and cord of the preferred embodiment of the present invention.

DETAILED DESCRIPTION OF THE PREFERRED EMBODIMENT

Figure 1:
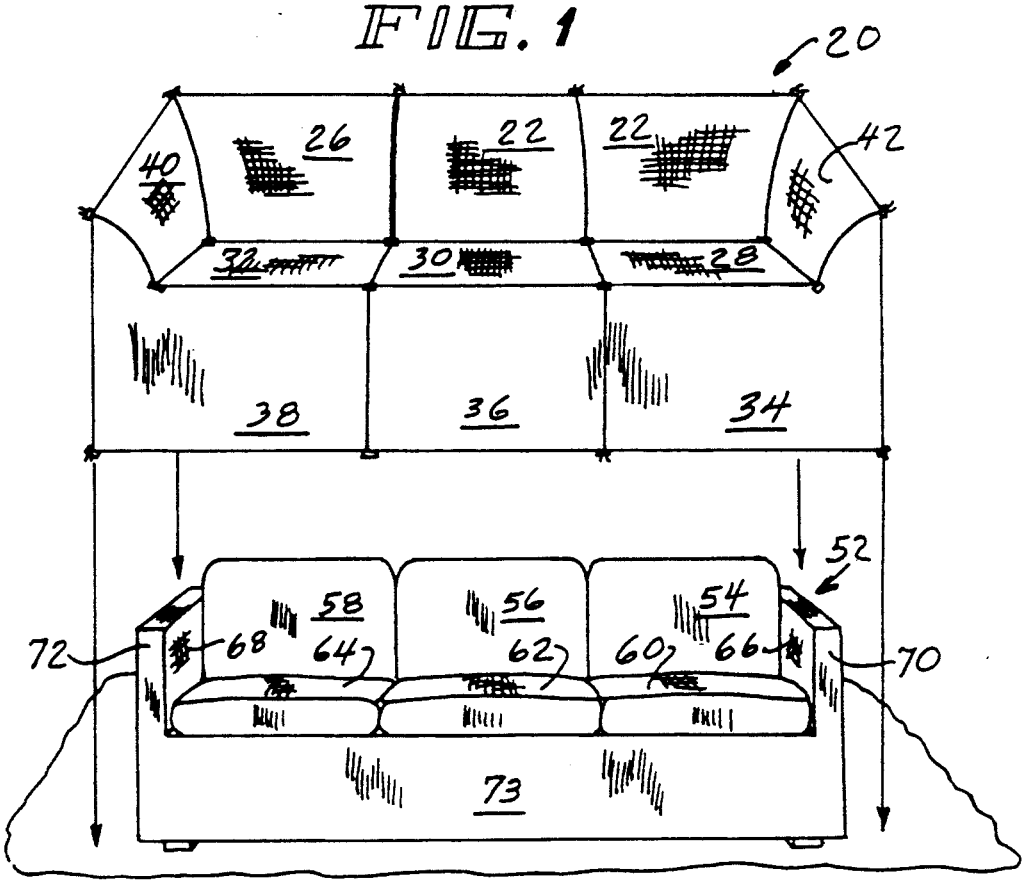
FIG. 1 is a front elevational view of the preferred embodiment of the present invention, shown in its fully-expanded state above a piece of furniture to be covered.

The preferred embodiment of the present inventive slipcover is designated generally in FIG. 1 as 20. The slipcover is primarily comprised of a series of flexible panels 22–48 (shown in FIGS. 1–3) which are sewn to each other at their edges.

Generally square left seat panel 32 is sewn at its edges to inside back panel 26, left arm panel 40, left front panel 38 and center seat panel 30. Similarly, seat panels 28 and 30 are sewn to back panels 22 and 24, front panels 34 and 36, arm panel 42 (with respect to right seat panel 28), left seat panel 32 (with respect to center seat panel 30) and to each other. Outer back panels 44, 46 and 48 are sewn to each other, left side panel 50 (with respect to left out back panel 44) and opposing right side panel (not shown specifically in the drawings, but having construction of the mirror image of side panel 50), and inside back panels 22, 24 and 26. The other panels are sewn together in the orientation shown in FIGS. 1–4.

Each panel is preferably made of 100% cotton, but alternatively could be made of other fabrics such as a cotton blend, nylon or other material known in the art for conventional upholstery, throws and slipcovers. Leather or plastic could be used for the panel materials. All the panels are preferably made of the same material, but alternatively different panels could be made of different materials or contain inserts of different materials.

The adjustable sofa slipcover 20 contains enough panels of adequate size to loosely cover a piece of furniture 52. Inside back panels 22, 24 and 26 are generally larger than corresponding back panels 54, 56 and 58 of the furnishing 52. Similarly, seat panels 28, 30 and 32 are larger than furniture seat panels 60, 62 and 64, and arm panels 40, 42 are larger than the insides 66, 68 of arms 70, 72 of the sofa to be covered. The three front panels 34, 36 and 38 together are larger than sofa front 73 and outside back panels 44, 46 and 48 are larger than the back of the sofa (not shown).

The panels join one another, as described above, at intersections. Although the preferred embodiment contemplates conventional sewing of panel edge to adjacent panel edge, other means, such as heat sealing or stapling could be used. Other methods known in the art for joining seams of material also could be used.

Each intersection seam has the two longitudinal edges of a long strip of material pinched together and attached in the seam (preferably by the sewing which also closes the seam) to form an elongated tubular channel of material. An example of a channel can be seen in FIGS. 1–4; channel 74 is located in the seam at the intersection of left arm panel 40 and left side panel 50. With reference to FIG. 10, elongated material 76 has its longitudinal edges 78, 80 edges folded on themselves along its length. The edges 78 and 80 are sewn into the seam to form a channel of flexible material with interior having generally tear drop shaped cross-section 82.

A lace or cord 84 is contained in the interior of tubular channel 76. The cord 84 is not laterally secured to the walls of the channel 76, but can freely slide longitudinally therein. The channel is preferably made of the same materials as the adjacent panels but alternatively could be made of any other flexible material known in the art capable of longitudinal compression. The cord is preferably a standard nylon cord but alternatively could be a fabric or leather lace or any other cord or lace known in the art.

The cord 84 exits channel 76 at two opposing ends 86, 88 of the channel. In a similar manner, cord 90 exits the end of channel 92 and cord 94 exits channel 96. The opposite ends of cords 90 and 94 exit channels 92 and 96 at the opposite ends of those channels (98 and 100 respectively).

A spring-biased grasping mechanism or stop 102 (preferably the BARRELLOCK TM stop by Illinois Tool Works, but alternatively any other device known in the art) has plunger 104 which, when manually pushed, acts against the bias of the internal spring. Cords 84, 90 and 94 run through the grasping mechanism 102 and have knotted ends 105 to avoid the inadvertant slipping off of the grasping mechanism from the cords 84, 90 and 94. The spring bias in the grasping mechanism 102 secures the mechanism 102 at the position where it is located along the cord. However, manual depression of the plunger 104 will release the mechanism 102 and allow the cords 84, 90 and 94 to be slid through it until the plunger 104 is released.

The dimensions of the grasping mechanism 102 are larger than the tear drop cross-section 82 of the channels 74, 92 and 96. The pulling of the cords 84, 90, 94 through the grasping mechanism 102 will restrict the length of the cords upon which the channels are restricted. Thus, the channels 74, 92, 96 are compressed upon an effectively reduced length of the cords 84, 90 and 94. The cords 74, 92 and 96 can be individually and reversibly slid through stop 102 to reduce the dimension of the seam at the selected panel intersection.

In addition, to triple cord intersections, the preferred embodiment will also contain quadruple cord intersections. As shown in FIGS. 4 and 9, channels 106, 108, 110 and 112 all have ends adjacent one another where center seat panel 30, right seat panel 28, center front panel 36 and right front panel 34 all meet. Cords 114, 116, 118 and 120 depart channels 106, 108, 110 and 112 respectively and are grasped by grasping mechanism 122. The effective length of the cords upon which the channels are restricted can be individually shortened as described herein.

Figure 2:
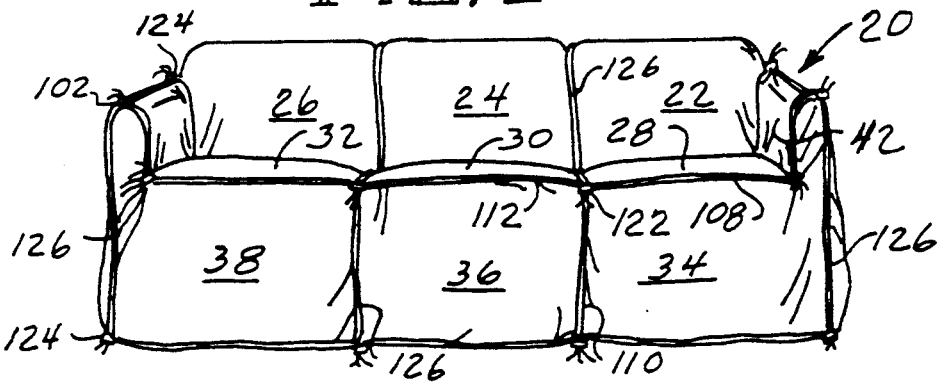
FIG. 2 is a front elevational view of the preferred embodiment shown covering a piece of furniture and with dimensions adjusted to fit the furnishing.
Figure 3:
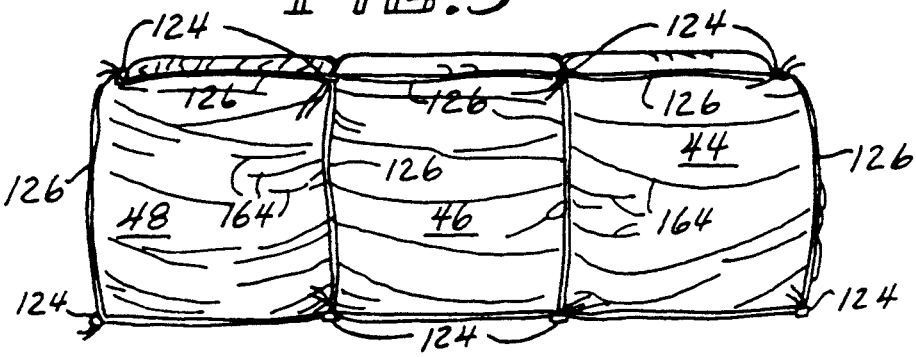
FIG. 3 is the rear elevational view of the embodiment shown in FIG. 2.

The sofa covering 20 has a plurality of other grasping mechanisms 124 (in addition to 102 and 122) shown in FIGS. 3 and 4. The manual pulling of the cords in the various channels 126 (other than those already designated 74, 92, 96, 106, 108, 110 and 112) will act to reduce the dimensions of the panel edges at the intersections to correspond to the dimensions of the corresponding sofa panels. Thus, the oversized covering 20 can have its dimensions manually adjusted to fit sofa 52 as shown in FIG. 2.

The principles of the invention are not limited to a specific piece of furniture but can be used in the design of adjustable slipcovers for a wide variety of sizes and shapes of furniture. Generally, the covering will contain a series of intersecting panels to correspond to the intersecting planes of the piece of furniture. Moreover, a single covering can be used on upholstered or unupholstered furniture of varying sizes and shapes.

FIGS. 5 and 6 show two examples of the configuration of the inventive adjustable covering for an armless chair 128 and arm chair 130 respectively. The armless chair has side panel 132, opposing side panel (not shown, but having mirror shape as 132), seat panel 134, front panel 136, inside back panel 138 and outside back panel (not shown). The center seat panel 134 is attached at its edges to both opposing side panel (one shown as 132), front panel 136 and inside back panel 138 at intersections where channels 140 are located. Inside back panel 138 also is shown to side panel 132, right side panel and outside back panel at channels 142. The other panels are joined together at channels 144 and other channels 146 are located at the lower edges of the covering 128.

The arm chair 130 similarly has seat panel 148, front panel 150, inside back panel 152, right arm panel 154, left arm panel 156, left side panel 158, right side panel (not shown, but mirror image of 158) and outside back panel (not shown). Channels 160 are located at the intersections of the panels and the bottom edge of the coverings as shown in FIG. 6. Both the armless chair 128 and arm chair 130 contain the grasping devices 162 described above at the points where channels intersect, shown in FIGS. 5 and 6 (and other points not shown). The coverings 128 and 130 are fitted to appropriate armless and arm chairs as described above for the sofa covering.

The invention contemplates a new method of adjustably and reversibly fitting a slipcover to fit a piece of furniture of the type described above. With respect to the sofa slipcover of FIGS. 1–4, and with reference to FIGS. 7–10, the slipcover 20 is placed to cover the sofa 52, the panel intersections 74, 92, 96, 106, 108, 110, 112 and 126 are then aligned with the corresponding parts of the sofa 52, and the position of the grasping mechanisms (or stops) 102, 122, 124 are adjusted on the cords (i.e., the cords slid through the grasping mechanisms) such that the channel is restricted to a length of the cords 84, 90, 94, 114, 116, 118 and 120 (and others in the other channels) corresponding to the associated dimension of the sofa 52.

The sofa slipcover 20 can be removed from the sofa 52 by reversing the steps described above. The plungers of the grasping mechanisms 102, 122, 124 are actuated and the mechanism pulled to near the end of the cords, lengthening the dimension of the cord upon which the channel can expand. The covering 20 can then be upwardly removed from the sofa 52. The covering 20 is then available for cleaning an aligning and adjusting on the same piece of furniture or on a second piece of furniture of the same or different dimensions as described above.

Unfitted throws contain excess material which either, if initially tucked between the cushions, easily becomes disheveled or is gathered in an unsightly manner. The preferred embodiment of the adjustable slipcover contemplated by the present invention allows for the creation of attractive folds 164 along the back of the sofa (or other piece of furniture). Thus, the excess material necessarily present in such an adjustable covering is attractively displayed and will not become easily disheveled upon use.

From the above description it will be apparent that there is provided an adjustable slipcover and a method having desireable advantages, but which are susceptible to modification in form, method, operation, detail of construction, and arrangement without departing from the inventive principles or sacrificing any of the advantages.

It is understood that the invention is not limited to the specific features shown, but that the means, method, and construction herein disclosed comprise only the preferred form of various possible modes of putting the invention into effect, and the invention is, therefore, claimed in any of its forms or modifications within the scope of the following claims.

What is claimed is:

1. A slipcover with adjustable dimensions to cover a piece of furniture defined by a series of intersecting planes, the slipcover comprising:

a series of intersecting panels corresponding to the series of intersecting planes of the piece of furniture, the series of panels attached to each other in such a manner as to be capable of covering the piece of furniture;

a plurality of tubular channel attached along their length to the panel intersections, the channels capable of longitudinal compression, each channel being approximately the length of the panel intersection to which it is attached, and each channel having opposing ends open to the channel interior;

a plurality of cords residing in the channels, each channel containing a cord, each cord departing from the channel in which it resides and capable of slidable movement within the channel; and means associated with the cords for reversibly longitudinally compressing the channel onto a portion of the cord;

whereby the length of the panel intersections can be reversibly shortened to correspond to the dimensions of the piece of furniture;

wherein a channel is associated with each panel intersection, a cord is slideably contained in each channel, and each cord departs from both ends of each channel.

2. An adjustable furniture slipcover comprising:

a first side panel;

a second side panel opposite of the first side panel;

a seat panel attached to the first and second side panels;

a front panel attached along its opposite sides to the first and second side panels, and along another side to the seat panel;

an inside back panel attached along opposite sides to the first and second side panels, and along another side to the seat panel;

an outer back panel attached along sides to the first and second side panels, and along another side to the inside back panel;

a plurality of channels formed at a plurality of panel intersections, each channel having at least one open end;

a plurality of cords contained in the channels, each cord having distal end accessible through the open end of the channel; and means for reversibly restricting movement of the channel ends relative to the cords.

3. An adjustable furniture slipcover comprising:

a first side panel;

a second side panel attached to the first side panel;

a seat panel attached along its sides to the first and second side panels;

first and second inside back panels attached to each other and each also attached to a side panel and the seat panel;

first and second outer back panels attached to each other and each also attached to a side panel and an inside back panel;

a plurality of channels formed at a plurality of panel intersections, each channel having at least one open end;

a plurality of cords contained in the channels, each cord having distal end accessible through the open end of the channel; and means for reversibly restricting movement of the channel ends relative to the cords.

4. An adjustable furniture slipcover comprising:

a first side panel;

a front panel attached along one edge to the first side panel;

a second side panel attached to the front panel opposite to the first side panel;

a seat panel attached to the front panel and the first and second side panels;

first and second arm panels, each attached to the front panel along one side and to the seat panel along another;

an inside back panel attached along its opposite edge to the first and second arm panels and along another edge to the seat panel;

an outer back panel attached along its opposite edges to the first and second side panels and along another edge to the inside back panel;

a plurality of channels formed at a plurality of panel intersections, end channel having at least one open end;

a plurality of cords contained in the channels, each cord having distal end accessible through the open end of the channel; and means for reversibly restricting movement of the channel ends relative to the cords.

5. The slipcover of claim 4 wherein the seat panel comprises a plurality of linearly arranged sub-panels, each sub-panel attached to another panel.

6. The slipcover of claim 5 wherein the back panel comprises a plurality of linearly arranged sub-panels, each sub-panel attached to another sub-panel.

7. The slipcover of claim 6 wherein the front panel comprises a plurality of linearly arranged sub-panels, each sub-panel attached to another sub-panel.

8. The slipcover of claim 7 wherein the number of seat, back and front sub-panels is the same and each seat sub-panel is attached along one edge to an opposite edge of a front sub-panel.

9. A method of adjustably and reversibly fitting a slipcover to fit a piece of furniture, the slipcover containing a series of panels attached to one another at panel intersections, the slipcover also containing a plurality of elongated tubular channels having two ends and slideably containing a cord, each channel attached along its length to an intersection, and each cord departing from at least one channel end, and a stop means associated with the cord for restricting movement of the channel end on the cord beyond the stop, the method comprising the steps of:

covering the piece of furniture with the slipcover;

aligning the panel intersections with corresponding parts of the piece of furniture; and adjusting the position of the stop means such that the channel is restricted to a length of cord corresponding to the associated dimension of the piece of furniture;

wherein the cord departs from both ends of the channel, each end of each cord contains a stop means, and further comprising the step of adjusting the positions of both stop means on each cord to restrict the length of cord between the stop means to a dimension corresponding to the associated dimension of the piece of furniture.

10. A method of adjustably and reversibly fitting a slipcover to fit a piece of furniture, the slipcover containing a series of panels attached to one another at panel intersections, the slipcover also containing a plurality of elongated tubular channels having two ends and slideably containing a cord, each channel attached along its length to an intersection, and each cord departing from at least one channel end, and a stop means associated with the cord for restricting movement of the channel end on the beyond the stop, the method comprising the steps of:

covering the piece of furniture with the slipcover;

aligning the panel intersections with corresponding parts of the piece of furniture; and adjusting the position of the stop means such that the channel is restricted to a length of corresponding to the associated dimension of the piece of furniture;

further comprising the step of removing the slipcover from the piece of furniture, covering a second piece of furniture with the slipcover, aligning the intersections to the corresponding parts of the second piece of furniture, and adjusting the stop means to restrict movement of the channel end to a dimension corresponding to the associated dimension of the second piece of furniture.

* * * * *